United States Patent [19]

Puhak et al.

[11] 4,158,152

[45] Jun. 12, 1979

[54] CRT BASE AND PIN PROTECTIVE MEANS

[75] Inventors: Peter G. Puhak; Paul C. Shaffer, both of Seneca Falls, N.Y.

[73] Assignee: GTE Sylvania Incorporated, Stamford, Conn.

[21] Appl. No.: 909,131

[22] Filed: May 24, 1978

[51] Int. Cl.[2] ..... H01J 29/00; H01R 33/74

[52] U.S. Cl. ..... 313/325; 339/144 T

[58] Field of Search ..... 313/325, 318; 339/144 T, 145 T

[56] References Cited

U.S. PATENT DOCUMENTS

| | | | |
|---|---|---|---|
| 4,075,531 | 2/1978 | Marino | 313/325 |
| 4,126,371 | 11/1978 | Puhak | 339/144 T |
| 4,127,313 | 11/1978 | Marks | 339/144 T |

*Primary Examiner*—Alfred E. Smith
*Assistant Examiner*—Charles F. Roberts
*Attorney, Agent, or Firm*—William H. McNeill

[57] ABSTRACT

A protective cap is provided for a cathode ray tube-base assembly. The cap incorporates discrete means for maintaining alignment and protection of an array of tube pins at least one is spatially encompassed within a tubular isolation structure of the base.

4 Claims, 3 Drawing Figures

CRT BASE AND PIN PROTECTIVE MEANS

CROSS REFERENCE TO RELATED APPLICATIONS

Attention is directed to two related co-pending U.S. patent applications: Ser. No. 857,596, now U.S. Pat. No. 4,126,371, and Ser. No. 857,597, both of which were filed Dec. 5, 1977. These applications are assigned to the assignee of the present invention and concern CRT pin alignment means.

BACKGROUND OF THE INVENTION

This invention relates to means for providing pin alignment and protection in a cathode ray tube-base assembly and more particularly to a protective cap having discrete means for providing alignment and protection for a protruding array of tube pins at least one of which is spatially encompassed within a substantially tubular isolation structure of the associated base member.

Advancement in cathode ray tube technology, in particular the tube types utilized in television and allied display applications, has produced efficient compacted electron gun structures which are incorporated in tube envelopes having reduced neck diameters. The operating potentials for the various elements of the gun structures are supplied via an annular array of connector pins sealed into and projecting from the stem closure portion of tube. As the neck diameters and associated closure-portions become smaller, the spacings between the connective pins decrease in a proportionate manner.

Many types of these tubes evidence large voltage differentials, i.e., in the order of 5 KV to 12 KV, between certain of the connector pins. Therefore, it has been found advantageous to incorporate a form of arc protection into the tube base and socket combination. Base and socket means have been provided in the art to minimize inter-pin arcing wherein at least one of the vulnerable high voltage pins is tubularly encompassed by one or more spatially related isolation structures integrally formed as part of the base member. In conjunction therewith, a compatible socket member contains receiving means to mate with the respective tubularly encompassed pin, thereby effecting an isolated high voltage connection which has been found to be very effective in controlling deleterious arcing.

Unfortunately, the isolated pin, positioned within the protective tubulation, sometimes is bent out of alignment during tube basing or as a result of subsequent tube mishandling. Once this happens, there is no facile way of straightening the pin due to the narrow dimensioning of the surrounding tubulation.

To prevent the pin from being deleteriously bent, a separate removable pin aligning insert has been devised to slidingly fit within the pin-accommodating tubulation. Such insert means, having a longitudinal bore therein to protectively encompass the respective pin, is dimensioned to snugly fit within the tubulation and be frictionally retained therein until removed prior to subsequent tube utilization. While the separate snug-fitting insert affords protection for the isolated pin, it is an individually handled unit and evidences no cooperative construction with any other base protective means. The retention of the insert is controlled by the external dimensions of the insert in conjunction with the internal dimensionings of the tubulation.

OBJECTS AND SUMMARY OF THE INVENTION

Accordingly, it is an object of the invention to reduce and obviate the disadvantages of the prior art.

It is another object of the invention to provide positive protection for the tubulation-encompassed pin and the other pins of the base array during the period between basing and ultimate usage.

Yet another object of the invention is the provision of a tube product of improved quality by assuring positive alignment of diversely oriented base pins at the time of tube utilization.

These and other objects and advantages are achieved in one aspect of the invention wherein protective means is provided for a cathode ray tube-base assembly having an annular array of connector pins protruding through a plurality of apertures surrounding a central crown portion in the base member. At least one of the pins is isolated by traversing a base aperture encompassed by a tubular isolation structure integrally formed as part of the base. The protective cap of the invention is formed to fit on the base of the tube and provide alignment-protection for the array of base pins protruding therefrom. The cap has a cut-out segment dimensioned to substantially straddle the tubular isolation structure of the base. A longitudinal projecting element, having a bore therein, is integrally attached to the wall of the cap and extends therefrom in a manner to ingress into the tubular isolation structure to protectively encompass the isolated pin therein.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

Figure 1:
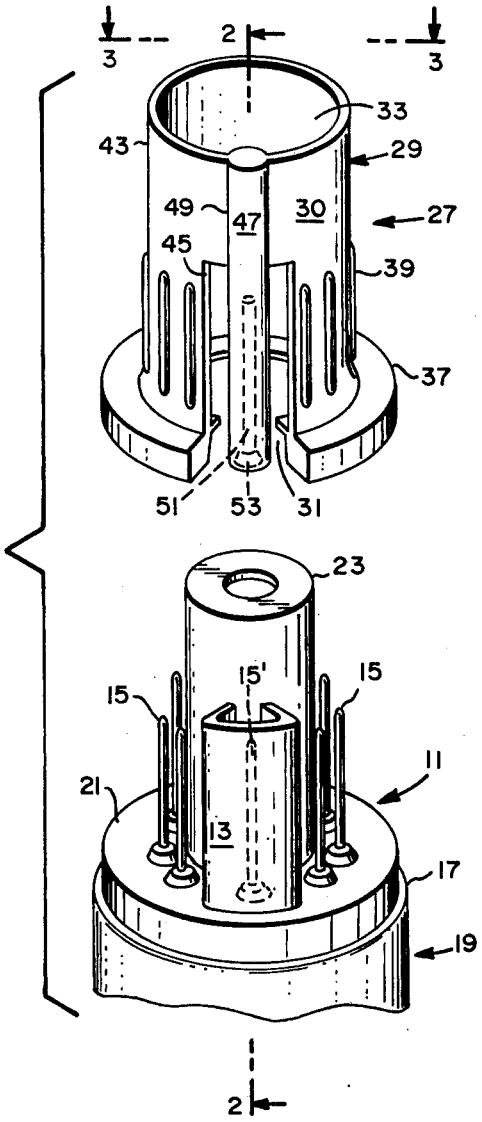
FIG. 1 is an exploded perspective showing the manner in which the protective means of the invention are associated with the tube-base combination.

With reference to the drawings, there is shown in FIG. 1 an exploded presentation wherein a particular type of cathode ray tube base 11, having a tubular pin isolating structure 13 incorporated therein, is positioned to receive the terminal array of connective pins 15–15' protruding from the neck closure portion 17 of the cathode ray tube 19.

Figure 2:
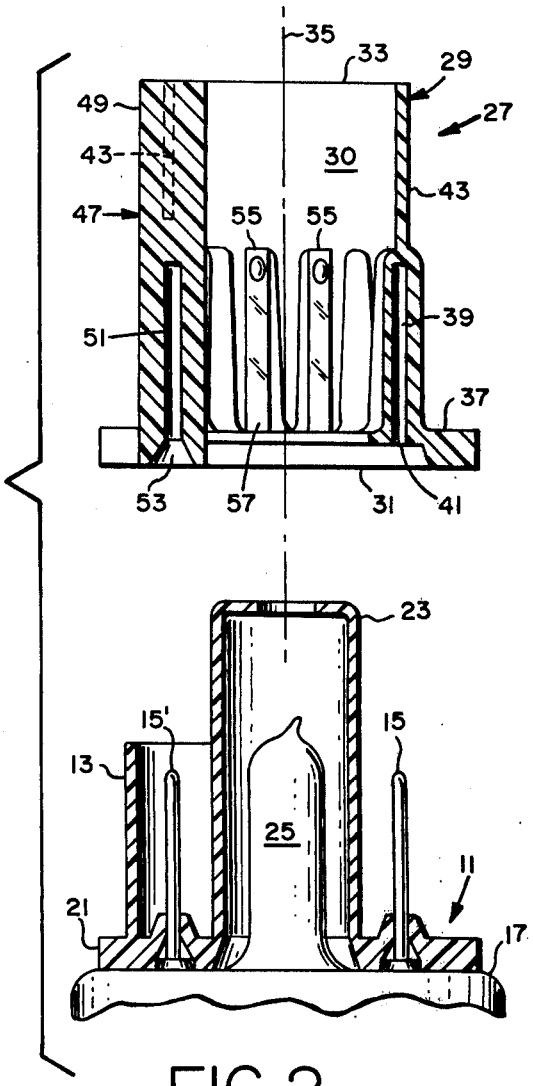
FIG. 2 is an exploded, sectioned, elevational view taken along the line 2—2 of FIG. 1.
Figure 3:
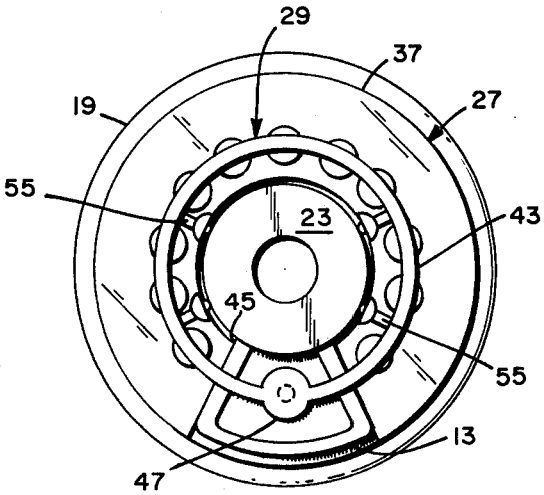
FIG. 3 is a top view of the invention positioned on the tube-base combination taken substantially along the line 3—3 of FIG. 1.

Referring to FIGS. 1, 2 and 3 in greater detail the tube base 11 comprises a substantially planar portion 21, having a central crown portion 23 fashioned to receive and protect the sealed tubulation 25. Surrounding the crown is an annular array of spaced-apart pin-receiving apertures through which the connector pins 15–15' protrude. The tubular pin isolating structure 13 is integrally formed as part of the base member and has a length exceeding that of the isolated pin 15' positioned therein. While the lateral configuration of the tubular structure is shown as being substantially quasi-trapezoidal, other cross-sectional shapings, such as round, ovate, triangular, square or rectangular are sometimes used.

A protective means or cap 27 is formed to securely seat on the base 11 and provide protection for the base and the tube pins 15–15' protruding therefrom. It comprises a hollow cylindrical body member 29 evidencing an arcuate wall 30 having proximal and distal open ends 31 and 33 with a longitudinal axis 35 therethrough. The proximal end 31 is formed as a terminal rim-like basal portion 37 which is fashioned to seat on the planar portion 21 of the tube base. The protective cap evidences a slight degree of resiliency, being fabricated of, for example, a plastic material such as natural, medium impact polystyrene.

The wall 30 of the body member has sufficient thickness in the proximal related region to have formed therein a plurality of longitudinal bores 39, which extend inwardly from an orderly arrangement of apertures 41 in the basal portion 37, to effect protective encompassment of the base pins 15 that mate therewith. The related distal portion 33 of the wall 30 is substantially formed as a closed band 43 of substantially uniform thickness.

Part of the wall 30 of the body member 29 has a defined cut-out segment 45 removed therefrom, extending from the distal related band 43 through the basal proximal region 31. This cut-out segment is dimensioned to substantially straddle the tubular isolation structure 13 of the base 11. As such, the cut-out functions as a sliding placement guide in cooperation with the isolation structure.

A longitudinal projecting element 47 is integrally attached to the distal portion 33 of the wall 30; the attachment portion 49 of the element being formed as part of the distally related closed band 43. This element is oriented and directed to extend from the closed band portion 43 spatially through the cut-out area toward the basal portion 37 in a plane parallel to the axis 35. In this manner the projecting element is positioned to spatially ingress into the tubular isolation structure 13 of the base 11. As shown, the lateral dimensioning of the projecting element 47 is substantially smaller than that of the receiving isolation structure 13. Such has proven to be advantageous for facile placement of the cap. While the rod-like structure is shown as being substantially round, such is not to be considered limiting. A longitudinal bore 51 with a substantially infundibular opening 53 is formed in the projecting element, such being aligned and dimensioned to accommodate the isolated base pin 15'. Since the spatially related element exhibits a degree of resiliency and has a funnel-like opening, it readily receives, aligns, and protectively encompasses the respective pin.

A plurality of substantially resilient wand-like retaining members 55 are spatially oriented peripherally within the hollow body member whereat the base ends 57 are affixed to the base portion of the cap. The substantially free-standing retaining wands 55 extend therefrom toward the distal portion 33 of the body member in a manner to frictionally engage the crown portion 23 of the base, thereby adhering the cap to the base.

The cap structure of the invention effects complete protection for the tube base and all of the connector tube pins associated therewith, whether they be in annular array or isolated orientation. The cap beneficially mates with the specialized construction of the base and provides complete and positive pin alignment and protection in a single unit.

While there has been shown and described what is at present considered the preferred embodiment of the invention, it will be obvious to those skilled in the art that various changes and modifications may be made therein without departing from the scope of the invention as defined by the appended claims.

What is claimed is:

1. Protective means for a cathode ray tube-base assembly wherein a substantially annular array of tube connector pins exteriorly protrude through a plurality of aligned apertures surrounding a central crown portion in the base member whereof at least one pin is isolated by traversing a base aperture ecompassed by a spatially related tubular isolation structure integrally formed as part of said base member and having a length exceeding that of the isolated pin positioned therein, said protective means being in the form of a cap comprising:

a hollow cylindrical body member evidencing a wall with proximal and distal open ends defining a central cavity therein and having a longitudinal axis therethrough, said proximal end being formed as a terminal rim-like basal portion fashioned to seat on said tube base, said basal portion having an orderly arrangement of apertures therein aligned to mate with the array of said tube pins, said body member wall having sufficient thickness in said proximal region to have formed therein a plurality of longitudinal bores extending inwardly from said apertures into said body member to effect protective encompassment of said tube pins, said distal portion of said wall being a closed band of substantially uniform thickness, said wall having a defined cut-out segment removed therefrom extending from said distal band through said basal proximal region and said basal portion, said cut-out segment being dimensioned to substantially straddle the tubular isolation structure of said tube base; a longitudinal projecting element integrally attached to the distal portion of said wall and extending therefrom spatially through said cut-out area toward said basal portion in a plane parallel to said axis in a manner to spatially ingress into said tubular isolation structure, said projecting element having a longitudinal bore with an opening therein aligned with and dimensioned to accommodate said isolated base pin; and a plurality of substantially resilient cap retaining members fixedly and spatially oriented peripherally within said body member in a manner to frictionally engage the crown portion of said base.

2. The protective means for a cathode ray tube-base assembly according to claim 1 wherein said longitudinal projecting element in conjunction with said associated distal wall portion evidence a degree of resiliency to enhance the accommodation of said isolated base pin.

3. The protective means for a cathode ray tube-base assembly according to claim 1 wherein said longitudinal projecting element is formed as a substantially round rod-like structure, and wherein said bore is axially formed therein, and wherein the opening of said bore is of infundibular shaping.

4. The protective means for a cathode ray tube-base combination according to claim 1 wherein said longitudinal projecting element has a free-standing portion that is of a length exceeding that of the isolated base pin accommodated therein.

* * * * *